US010133232B2

(12) United States Patent
Itabashi

(10) Patent No.: US 10,133,232 B2
(45) Date of Patent: Nov. 20, 2018

(54) IMAGE FORMING APPARATUS INCLUDING FRAME AND CARTRIDGE ATTACHABLE THERETO

(71) Applicant: BROTHER KOGYO KABUSHIKI KAISHA, Nagoya, Aichi (JP)

(72) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 18 days.

(21) Appl. No.: 15/457,113

(22) Filed: Mar. 13, 2017

(65) Prior Publication Data

US 2017/0269543 A1 Sep. 21, 2017

(30) Foreign Application Priority Data

Mar. 18, 2016 (JP) ..... 2016-054698

(51) Int. Cl.
*G03G 15/08* (2006.01)
*G03G 21/16* (2006.01)

(52) U.S. Cl.
CPC ..... *G03G 21/1652* (2013.01); *G03G 21/1661* (2013.01)

(58) Field of Classification Search
CPC ..... G03G 21/1652; G03G 21/1661; G03G 21/1642; G03G 21/1676
See application file for complete search history.

(56) References Cited

U.S. PATENT DOCUMENTS 7,742,717 B2 * 6/2010 Kim ..... G03G 15/0896 399/107
8,909,071 B2 * 12/2014 Takahashi ..... G03G 21/1652 399/12
2011/0064457 A1 3/2011 Okabe et al.
2013/0051849 A1 2/2013 Itabashi et al.
2015/0037050 A1 * 2/2015 Kimura ..... G03G 15/0863 399/12
2015/0261177 A1 * 9/2015 Moon ..... G03G 21/1676 399/90

(Continued)

FOREIGN PATENT DOCUMENTS

JP 2011-059510 A 3/2011
JP 2013-054058 A 3/2013

*Primary Examiner* — David M Gray
*Assistant Examiner* — Michael Harrison
(74) *Attorney, Agent, or Firm* — Scully, Scott, Murphy & Presser, PC

(57) ABSTRACT

An image forming apparatus including a frame and a cartridge attachable thereto. The cartridge includes a casing, a storage medium including an electrical contact surface, and a holder positioned at one side of the casing in a first direction. The holder includes a first outer surface holding the electrical contact surface. The first outer surface is movable relative to the casing in a second direction. The frame includes first and second guide surfaces, an electrical contact configured to contact the electrical contact surface, and a support surface. A gap distance between the first and second guide surfaces in the second direction is reduced from a first distance to a second distance in an inserting direction. The electrical contact is positioned farther from an insertion opening of the frame than the first guide surface. A gap distance between the electrical contact and the support surface is greater than the second distance.

16 Claims, 15 Drawing Sheets

(56) References Cited

U.S. PATENT DOCUMENTS

| | | | | |
|---|---|---|---|---|
| 2017/0184998 | A1* | 6/2017 | Itabashi | G03G 15/0865 |
| 2017/0185032 | A1* | 6/2017 | Itabashi | G03G 15/0875 |
| 2017/0269544 | A1* | 9/2017 | Itabashi | G03G 21/1676 |

* cited by examiner

IMAGE FORMING APPARATUS INCLUDING FRAME AND CARTRIDGE ATTACHABLE THERETO

CROSS REFERENCE TO RELATED APPLICATION

This application claims priority from Japanese Patent Application No. 2016-054698 filed Mar. 18, 2016. The entire content of the priority application is incorporated herein by reference.

TECHNICAL FIELD

The present disclosure relates to an image forming apparatus.

BACKGROUND

An electro-photographic type image forming apparatus such as a laser printer and LED printer is known in the art. Such apparatus uses a developing cartridge having a developing roller for toner supply. Prior art discloses an image forming apparatus including a drawer unit including a photosensitive drum. A developing cartridge is attached to the drawer unit. Upon attachment of the developing cartridge to the drawer unit, the developing roller and the photosensitive drum contact each other.

Prior art also discloses a drum cartridge and a developing cartridge attachable to the drum cartridge. The drum cartridge includes a photosensitive drum. Upon attachment of the developing cartridge to the drum cartridge, the developing roller and the photosensitive drum contact each other. In a state where the developing cartridge is attached to the drum cartridge, the drum cartridge is attached to an image forming apparatus.

Further, a developing cartridge including a storage medium such as IC chip is known. The storage medium includes an electrical contact surface configured to contact an electrical terminal of an image forming apparatus or an electrical terminal of a drawer unit.

SUMMARY

However, the electrical contact surface may be scraped against a portion of the image forming apparatus or the drawer unit during attachment of the developing cartridge to the image forming apparatus or the drawer unit.

It is therefore an object of the disclosure to provide an image forming apparatus capable of reducing frictional wearing of the electrical contact surface that is provided at a cartridge.

In order to attain the above and other objects, according to one aspect, the disclosure provides an image forming apparatus including a cartridge and a frame to which the cartridge is attachable. The cartridge includes a casing, a storage medium, and a holder. The casing extends in a first direction and is configured to accommodate developing agent. The storage medium includes an electrical contact surface. The holder is positioned at one side of the casing in the first direction. The holder includes a first outer surface positioned at one end portion of the holder in a second direction crossing the electrical contact surface. The first outer surface holds the electrical contact surface, and is movable with respect to the casing in the second direction. The frame has an insertion opening. The frame includes a first guide surface, a second guide surface, an electrical contact, and a support surface. The second guide surface is spaced away from the first guide surface in the second direction. The holder is inserted between the first guide surface and the second guide surface in an inserting direction in a case where the holder is attached to the frame. A gap distance between the first guide surface and the second guide surface in the second direction is gradually reduced from a first distance to a second distance in the inserting direction. The electrical contact is configured to contact the electrical contact surface. The electrical contact is positioned farther from the insertion opening than the first guide surface is from the insertion opening. The support surface faces the electrical contact in the second direction. A gap distance between the electrical contact and the support surface is greater than the second distance.

BRIEF DESCRIPTION OF THE DRAWINGS

The particular features and advantages of the disclosure will become apparent from the following description taken in connection with the accompanying drawings, in which.

DETAILED DESCRIPTION

An image forming apparatus according to one embodiment will be described with reference to the accompanying drawings.

<1. Outline of Image Forming Apparatus>

Figure 1:
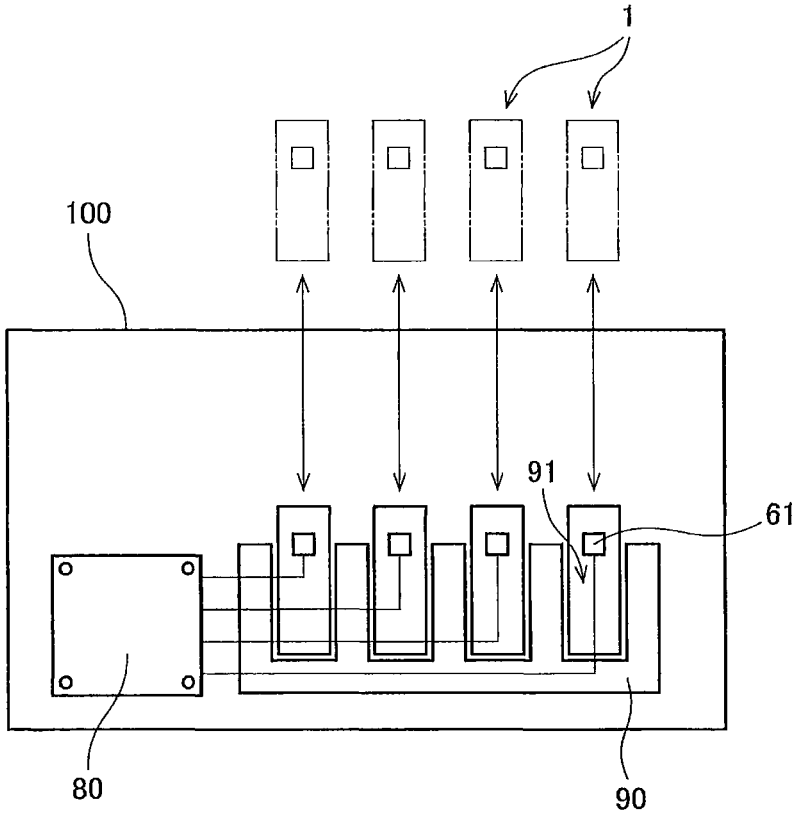
FIG. 1 is a conceptual diagram of an image forming apparatus according to one embodiment.

FIG. 1 is a conceptual diagram of an image forming apparatus 100 as an example of the image forming apparatus according to the embodiment. The image forming apparatus 100 is an electro-photographic type printer such as a laser printer and an LED printer. The image forming apparatus 100 includes four developing cartridges 1, a drawer unit 90, and a controller 80.

The drawer unit 90 is a frame to witch the four developing cartridges 1 are attachable. In the image forming apparatus 100, an image is formed on a recording surface of a printing sheet with developing agent, such as toner, supplied from the four developing cartridges 1.

Figure 2:
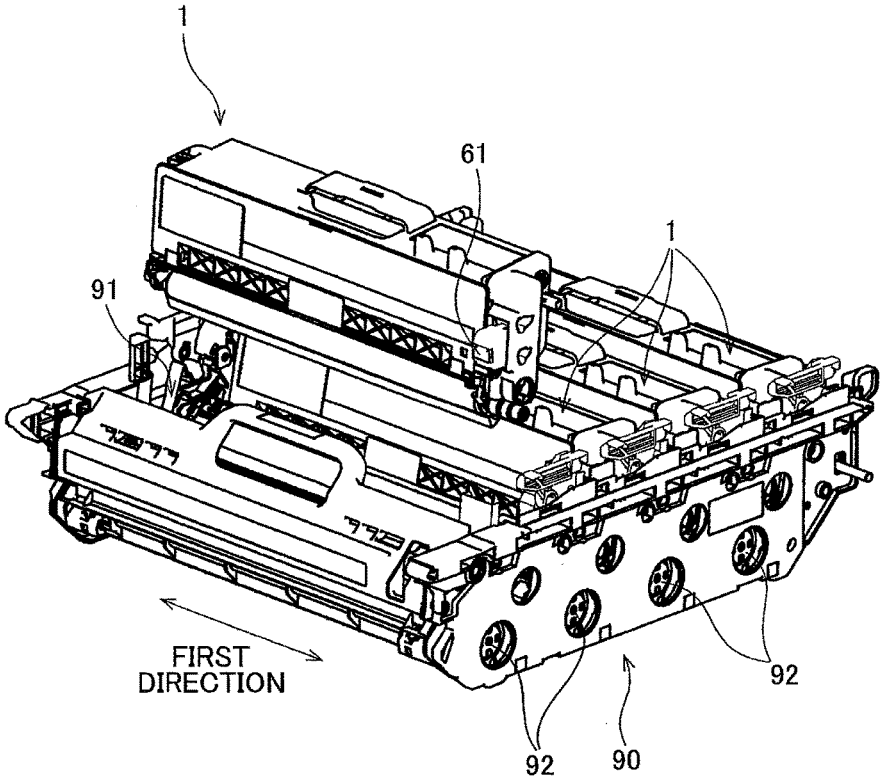
FIG. 2 is a perspective view of a drawer unit and developing cartridges in the image forming apparatus according to the embodiment.

FIG. 2 is a perspective view of the drawer unit 90 and the developing cartridges 1. As illustrated in FIGS. 1 and 2, each of the four developing cartridges 1 can be individually replaced in the drawer unit 90. For replacing the developing cartridge 1 with a new developing cartridge, the drawer unit 90 is pulled out from a front surface of the image forming apparatus 100. Subsequently, each of the developing cartridges 1 is detached from each of four slots 91 provided at the drawer unit 90, and then each of the new developing cartridges is attached to each of the slots 91. The drawer unit 90 includes four photosensitive drums 92. The four photosensitive drums 92 are positioned adjacent to respective ones of bottom portions of the slots 91. The photosensitive drum 92 is rotatable about a rotation axis (first axis) extending in horizontal direction. In the following direction, an extending direction of the rotation axis of the photosensitive drum 92 will be referred to as a first direction.

In the present embodiment, the four developing cartridges 1 are attached to the single drawer unit 90. The four developing cartridges 1 accommodate therein developing agents of different colors such as a color of cyan, magenta, yellow and black. However, the number of the developing cartridge attached to the drawer unit 90 is not limited to four, but one to three cartridges or not less than five cartridges are available.

As illustrated in FIGS. 1 and 2, each of the four developing cartridges 1 includes an IC chip 61. The IC chip 61 is an example of a storage medium that is readable and writable. Hence, information stored in the IC chip 61 can be read out, and information can be written into the IC chip 61. As a result of attachment of the four developing cartridges 1 to the drawer unit 90, each of the IC chips 61 is electrically connected to the controller 80. The controller 80 is constituted by a circuit board. The controller 80 includes a processor such as CPU, and various memories. The processor operates according to programs, thereby causing the controller 80 to execute various processing in the image forming apparatus 100.

<2. Overall Structure of Developing Cartridge>

Figure 3:
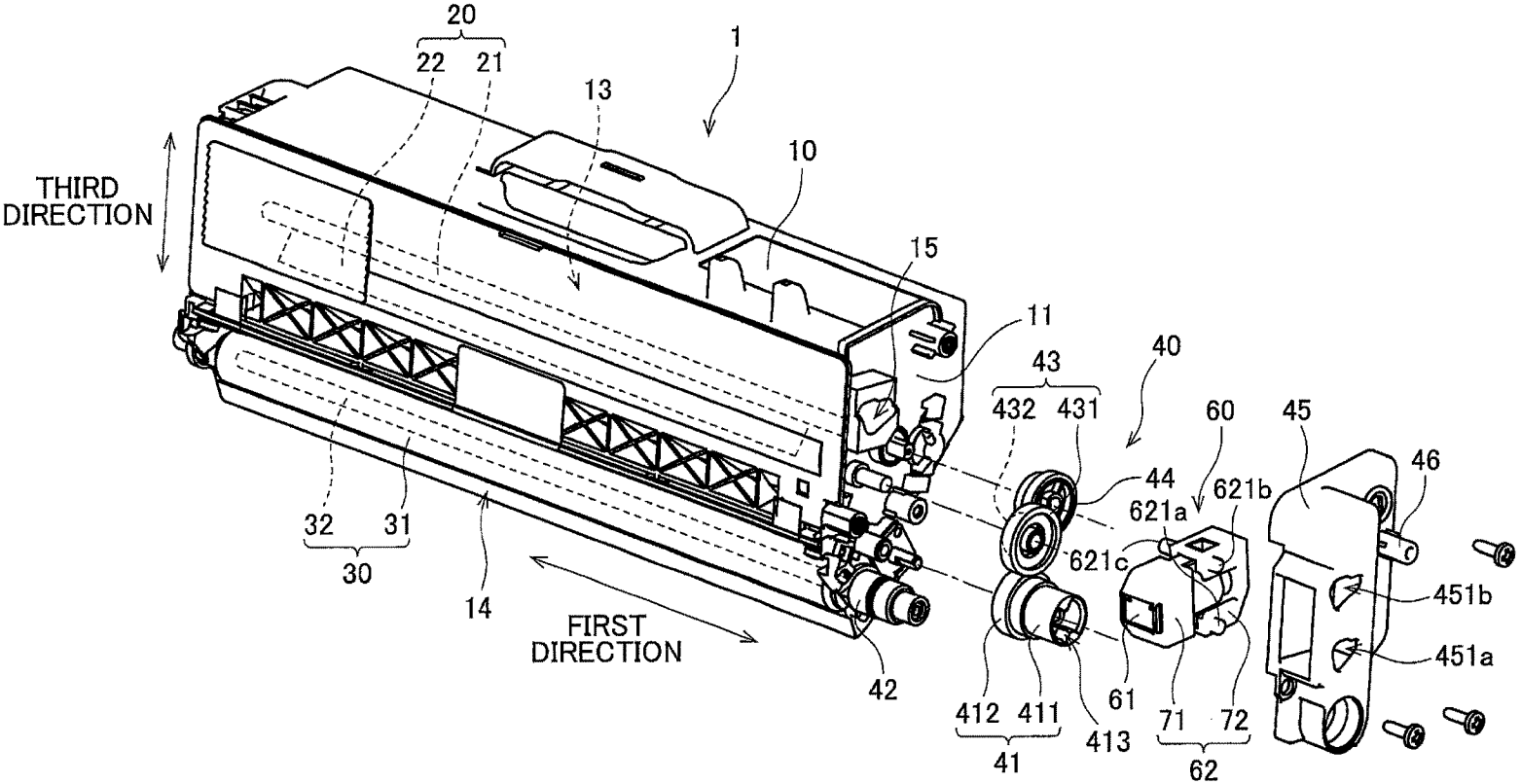
FIG. 3 is a perspective view of the developing cartridge.
Figure 4:
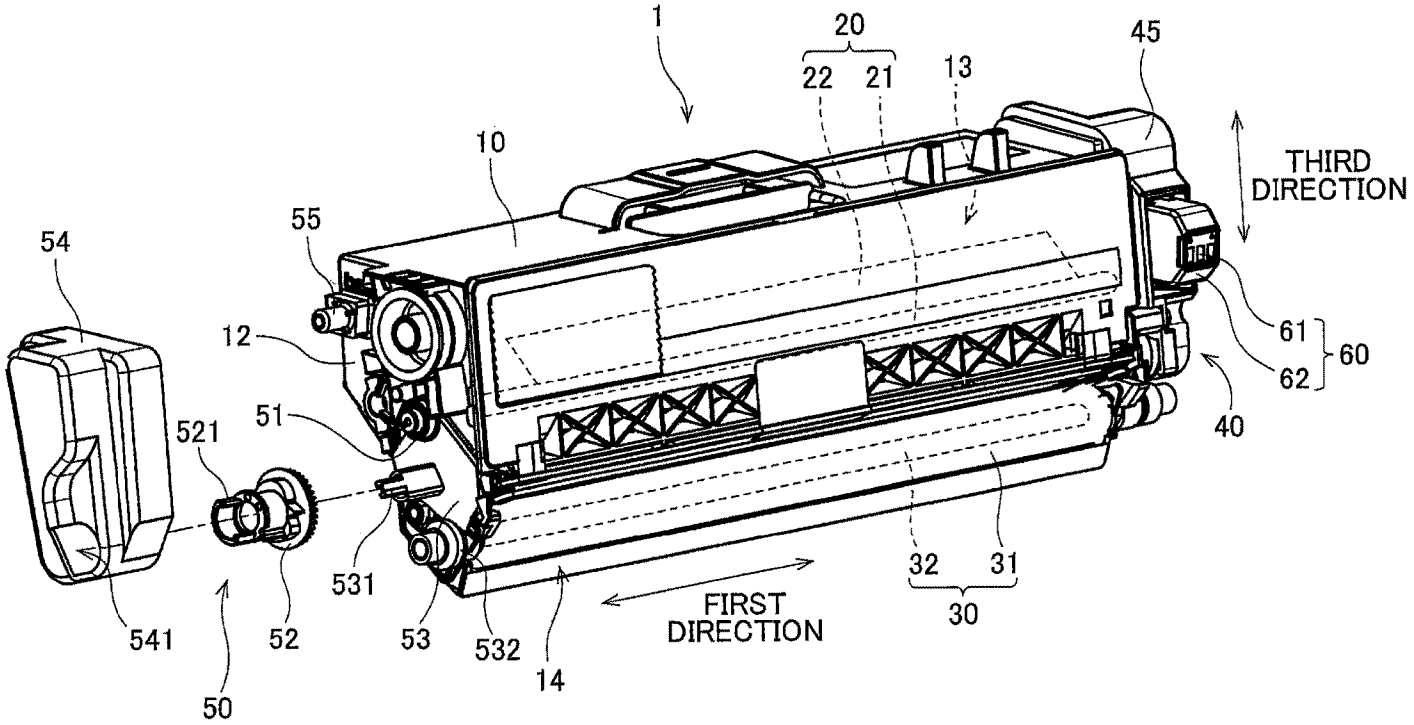
FIG. 4 is another perspective view of the developing cartridge.

FIGS. 3 and 4 are perspective views of the developing cartridge 1. As illustrated in FIGS. 3 and 4, the developing cartridge 1 includes a casing 10, an agitator 20, a developing roller 30, a first gear portion 40, a second gear portion 50, and an IC chip assembly 60.

The casing 10 is a container configured to accommodate developing agent. The casing 10 has a first end surface 11 and a second end surface 12. The casing 10 extends in the first direction between the first end surface 11 and the second end surface 12. The first gear portion 40 and the IC chip assembly 60 are positioned at the first end surface 11, and the second gear portion 50 is positioned at the second end surface 12. An accommodation chamber 13 is provided in an interior of the casing 10. The accommodation chamber accommodates the developing agent. The casing 10 has an opening portion 14. The opening portion 14 is positioned at an end portion of the casing 10 in an inserting direction where the developing cartridge 1 is inserted to the drawer unit 90. The accommodation chamber 13 and an outside of the casing 10 are communicated with each other through the opening portion 14.

The agitator 20 includes an agitator shaft 21 and an agitation blade 22. The agitator shaft 21 extends in the first direction. The agitation blade 22 extends radially outward from the agitator shaft 21. At least a portion of the agitator shaft 21 and the agitation blade 22 are positioned in the accommodation chamber 13. The agitator shaft 21 includes one end portion and the other end portion in the first direction. A first agitator gear 44 (described later) is mounted to the one end portion of the agitator shaft 21. A second agitator gear 51 (described later) is mounted to the other end portion of the agitator shaft 21. Thus, the agitator shaft 21 and the agitation blade 22 rotate together with both the first agitator gear 44 and the second agitator gear 51. Upon rotation of the agitation blade 22, the developing agent in the accommodation chamber 13 is agitated.

The developing roller 30 is a roller rotatable about a rotation axis (second axis) extending in the first direction. The developing roller 30 is positioned at the opening portion 14 of the casing 10. In the present embodiment, the developing roller 30 includes a roller body 31 and a developing roller shaft 32. The roller body 31 is a hollow cylindrical member extending in the first direction. The roller body 31 is made from a material, such as rubber, having elasticity. The developing roller shaft 32 is a solid cylindrical member extending through the roller body 31 in the first direction. The developing roller shaft 32 is made from metal or resin having electrical conductivity. The roller body 31 is fixed to the developing roller shaft 32 so as not to rotate relative rotation to the developing roller shaft 32.

The developing roller shaft 32 includes one end portion in the first direction. The one end portion of the developing roller shaft 32 in the first direction is fixed to a developing roller gear 42 (described later) so as not to rotate relative to the developing roller gear 42. Hence, the developing roller shaft 32 is rotated upon rotation of the developing roller gear 42, whereby the roller body 31 is also rotated together with the developing roller shaft 32.

Incidentally, the developing roller shaft 32 need not necessarily extend through the roller body 31 in the first direction. For example, each of a pair of developing roller shafts 32 extends in the first direction from each end portion of the roller body 31 in the first direction.

The developing cartridge 1 further includes a supply roller (not illustrated) positioned between the developing roller 30 and the accommodation chamber 13. The supply roller is rotatable about a rotation axis extending in the first direction. In a state where the developing cartridge 1 receives driving force, developing agent is supplied from the accommodation chamber 13 of the casing 10 to an outer peripheral surface of the developing roller 30 (specifically, an outer peripheral surface of the roller body 31) via the supply roller. In this instance, developing agent is subject to triboelectric charging at a position between the supply roller and the developing roller 30. On the other hand, bias voltage is applied to the developing roller shaft 32 of the developing roller 30. Accordingly, developing agent is attracted to the outer peripheral surface of the roller body 31 by electrostatic force generated between the developing roller shaft 32 and the developing agent.

The developing cartridge 1 further includes a layer thickness regulation blade (not illustrated). The regulation blade is configured to regulate a thickness of a layer of the developing agent supplied to the outer peripheral surface of the roller body 31 so that the thickness of layer is formed to a constant thickness. Then, the developing agent on the outer peripheral surface of the roller body 31 is supplied to the photosensitive drum 92 provided at the drawer unit 90. In this case, the developing agent is moved from the roller body 31 to the photosensitive drum 92 in accordance with an electrostatic latent image formed on an outer peripheral surface of the photosensitive drum 92. Thus, the electrostatic latent image becomes a visible image on the outer peripheral surface of the photosensitive drum 92.

The first gear portion 40 is positioned at the first end surface 11 of the casing 10. FIG. 3 is a perspective view of the developing cartridge 1 in a state where the first gear portion 40 is disassembled. As illustrated in FIG. 3, the first gear portion 40 includes a coupling 41, the developing roller gear 42, an idle gear 43, the first agitator gear 44, and a first cover 45. Incidentally, a plurality of gear teeth of these gears is omitted in FIG. 3.

The coupling 41 is configured to receive driving force supplied from a main body of the image forming apparatus 100. The coupling 41 is rotatable about a rotation axis extending in the first direction. The coupling 41 includes a coupling portion 411 and a coupling gear 412. For example, the coupling portion 411 and the coupling gear 412 are integrally formed of resin. The coupling portion 411 has a coupling hole 413 recessed in the first direction. A plurality of gear teeth are provided throughout an entire outer circumferential surface of the coupling gear 412. The plurality of gear teeth are spaced away from each other at a constant interval in a circumferential direction of the coupling gear 412.

In a state where the drawer unit 90 to which the developing cartridge 1 is attached is accommodated in the main body of the image forming apparatus 100, a drive shaft (not illustrated) of the main body of the image forming apparatus 100 is inserted into the coupling hole 413 of the coupling portion 411. Thus, the drive shaft and the coupling portion 411 are coupled with each other so that relative rotation between the drive shaft and the coupling portion 411 is prevented. Accordingly, the coupling portion 411 is rotated upon rotation of the drive shaft, so that the coupling gear 412 is also rotated together with the coupling portion 411.

The developing roller gear 42 is configured to rotate the developing roller 30. The developing roller gear 42 is rotatable about a rotation axis extending in the first direction. A plurality of gear teeth are provided throughout an entire outer circumferential surface of the developing roller gear 42. The plurality of gear teeth are spaced away from each other at a constant interval in a circumferential direction of the developing roller gear 42. A portion of the plurality of gear teeth of the coupling gear 412 are in meshing engagement with a portion of the plurality of gear teeth of the developing roller gear 42. The developing roller gear 42 is fixed to the one end portion of the developing roller shaft 32 in the first direction so as not to rotate relative to the developing roller shaft 32. Therefore, the developing roller gear 42 is rotated upon rotation of the coupling gear 412, so that the developing roller 30 is rotated together with the developing roller gear 42.

The idle gear 43 is configured to transmit rotation of the coupling gear 412 to the first agitator gear 44. The idle gear 43 is rotatable about a rotation axis extending in the first direction. The idle gear 43 includes a large diameter gear portion 431 and a small diameter gear portion 432 which are arrayed in the first direction. The small diameter gear portion 432 is positioned between the large diameter gear portion 431 and the first end surface 11 of the casing 10. In other words, the large diameter gear portion 431 is positioned farther from the first end surface 11 than the small diameter gear portion 432 is from the first end surface 11. A diameter of an addendum circle of the small diameter gear portion 432 is smaller than that of the large diameter gear portion 431. The large diameter gear portion 431 and the small diameter gear portion 432 are integrally formed of resin.

A plurality of gear teeth are provided throughout each of entire outer circumferential surfaces of the large diameter gear portion 431 and the small diameter gear portion 432. The plurality of gear teeth of the large diameter gear portion 431 are spaced away from each other at a constant interval in a circumferential direction of the large diameter gear portion 431. The plurality of gear teeth of the small diameter gear portion 432 are also spaced away from each other at a constant interval in a circumferential direction of the small diameter gear portion 432. The number of gear teeth of the small diameter gear portion 432 is smaller than the number of gear teeth of the large diameter gear portion 431. A portion of the plurality of gear teeth of the coupling gear 412 and a part of the plurality of gear teeth of the large diameter gear portion 431 are in meshing engagement with each other. Further, a portion of the plurality of gear teeth of the small diameter gear portion 432 and a portion of the plurality of gear teeth of the first agitator gear 44 are in meshing engagement with each other. The large diameter gear portion 431 is rotated upon rotation of the coupling gear 412, so that the small diameter gear portion 432 is also rotated together with the large diameter gear portion 431. Further, this rotation of the small diameter gear portion 432 causes the first agitator gear 44 to be rotated.

The first agitator gear 44 is configured to rotate the agitator 20 provided in the accommodation chamber 13. The first agitator gear 44 is rotatable about a rotation axis extending in the first direction. A plurality of gear teeth are provided throughout an entire outer circumferential surface of the first agitator gear 44. The plurality of gear teeth are spaced away from each other at a constant interval in a circumferential direction of the first agitator gear 44. As described above, the portion of the plurality of gear teeth of the small diameter gear portion 432 and the portion of the plurality of gear teeth of the first agitator gear 44 are in meshing engagement with each other. Further, the first agitator gear 44 is fixed to the one end portion of the agitator shaft 21 in the first direction so as not to rotate relative to the agitator shaft 21. Therefore, upon transmission of power from the coupling 41 to the first agitator gear 44 through the idle gear 43, the first agitator gear 44 is rotated, so that the agitator 20 is also rotated together with the first agitator gear 44.

The first cover 45 is fixed to the first end surface 11 by, for example screws. The coupling gear 412, the developing roller gear 42, the idle gear 43, and the first agitator gear 44 are accommodated between the first end surface 11 and the first cover 45. Specifically, the first cover 45 includes an inner surface facing the first end surface 11 in the first direction. The coupling gear 412, the developing roller gear 42, the idle gear 43, and the first agitator gear 44 are accommodated between the first end surface 11 and the inner surface of the first cover 45 in the first direction. The coupling hole 413 is exposed to the outside of the first cover 45. The first cover 45 includes a first columnar protrusion 46 extending in the first direction. In the present embodiment, the first cover 45 also serves as a holder cover for holding a holder 62 (described later) of the IC chip assembly 60. The configuration of the first cover 45 as the holder cover will be described later.

The second gear portion 50 is positioned at the second end surface 12 of the casing 10. FIG. 4 is a perspective view of the developing cartridge 1 in a state where the second gear portion 50 is disassembled. As illustrated in FIG. 4, the second gear portion 50 includes the second agitator gear 51, a detection gear 52, an electrically conductive member 53, and a second cover 54. In FIG. 4, a plurality of gear teeth of the second agitator gear 51 is omitted.

The second agitator gear 51 is configured to transmit rotation of the agitator shaft 21 to the detection gear 52. The second agitator gear 51 is rotatable about a rotation axis extending in the first direction. A plurality of gear teeth are provided throughout an entire outer circumferential surface of the second agitator gear 51. The plurality of gear teeth are spaced away from each other at a constant interval in a circumferential direction of the second agitator gear 51. In a state where the developing cartridge 1 is a new (non-used) cartridge, a portion of the plurality of gear teeth of the second agitator gear 51 are capable of being meshingly engaged with a portion of the plurality of gear teeth of the detection gear 52. Further, the second agitator gear 51 is fixed to the other end portion of the agitator shaft 21 in the first direction so as not to rotate relative to the agitator shaft 21. Therefore, the second agitator gear 51 is rotated upon rotation of the agitator shaft 21.

The detection gear 52 is a gear for transmitting information of the developing cartridge 1 to the image forming apparatus 100. Examples of the information of the developing cartridge 1 include the information as to whether or not the developing cartridge 1 is a new cartridge or used cartridge and information as to specification of the cartridge. For example, the specification of the cartridge includes yield information such as information as to amount of developing agent contained in the cartridge and information indicative of printable numbers of sheets with the developing agent.

The detection gear 52 is rotatable about a rotation axis extending in the first direction. A portion of the outer circumferential surface of the detection gear 52 includes a plurality of gear teeth. In a case where the drawer unit 90 to which a new developing cartridge 1 is attached is accommodated in the image forming apparatus 100, the coupling 41 receives driving force from the main body of the image forming apparatus 100. Then, the second agitator gear 51 is rotated by the driving force transmitted from the coupling 41 through the idle gear 43, the first agitator gear 44, and the agitator 20. The detection gear 52 is rotated by meshing engagement with the second agitator gear 51. However, since the plurality of gear teeth are provided only at the portion of the outer circumferential surface of the detection gear 52, the detection gear 52 is disengaged from the second agitator gear 51 as a result of predetermined angular rotation of the detection gear 52, thereby stopping rotation of the detection gear 52.

In this way in the image forming apparatus 100, the detection gear 52 and the second agitator gear 51 are in disengagement from each other with respect to the developing cartridge 1 that has been already used. Thus, in a state where the used developing cartridge 1 is detached from the image forming apparatus 100 and is then re-attached to the image forming apparatus 100, the rotation of the second agitator gear 51 is not transmitted to the detection gear 52, and accordingly, the detection gear 52 does not rotate.

Incidentally, additional gears may be positioned between the second agitator gear 51 and the detection gear 52. For example, the second gear portion 50 may further include a second idle gear engaged with both the second agitator gear 51 and the detection gear 52. In this case, the rotation of the second agitator gear 51 may be transmitted to the detection gear 52 through the second idle gear.

As illustrated in FIG. 4, the detection gear 52 includes a detecting protrusion 521 protruding in the first direction. The detecting protrusion 521 is arcuate in shape about the rotation axis of the detection gear 52. The detecting protrusion 521 is rotated upon rotation of the detection gear 52. That is, rotational position of the detecting protrusion 521 is changed in accordance with the rotation of the detection gear 52.

The electrically conductive member 53 is made from an electrically conductive material such as metal and electrically conductive resin. The electrically conductive member 53 is positioned at the second end surface 12 of the casing 10. The electrically conductive member 53 includes a gear shaft 531 and a bearing portion 532. The gear shaft 531 has a hollow cylindrical shape extending in the first direction. The detection gear 52 is supported by and rotatable about the gear shaft 531. The detecting protrusion 521 covers a portion of a periphery of the gear shaft 531. The bearing portion 532 is in contact with the developing roller shaft 32 of the developing roller 30.

The drawer unit 90 includes a lever (not illustrated) and an optical sensor (not illustrated). The lever has electrical conductivity, and is configured to contact the gear shaft 531. In a state where the lever is brought into contact with the gear shaft 531, the electrically conductive member 53 and the developing roller shaft 32 are electrically connected to the lever. In driving state of the image forming apparatus 100, the developing roller shaft 32 is maintained at a predetermined bias voltage by electric power supplied through the lever.

The detecting protrusion 521 covers a portion of an outer circumferential surface of the gear shaft 531. Therefore, after the new developing cartridge 1 is inserted into the drawer unit 90, a contact state between the lever and the gear shaft 531 is changed dependent on a shape of the detection gear 52 during rotation of the detection gear 52. That is, the lever is temporarily moved away from the gear shaft 531. The image forming apparatus 100 detects the displacement of the lever by the optical sensor. Through the detection of the displacement of the lever, the controller 80 of the image forming apparatus 100 identifies whether or not the attached developing cartridge 1 is a new cartridge, and also identifies specification of the developing cartridge 1 on the basis of the detection signal obtained from the optical sensor.

In this way, in the present embodiment, the optical sensor detects movement of the detecting protrusion 521 through the lever. However, the optical sensor may directly detect the movement of the detecting protrusion 521. Further, a magnetic sensor or a contact type sensor is available instead of the optical sensor. Further, the movement of the detecting protrusion 521 may be detected on a basis of whether or not an electrical continuity between the lever and the gear shaft 531 is present.

Further, in the present embodiment, the gear shaft 531 is a portion of the electrically conductive member 53. However, a gear shaft may be provided independent of a power supply path to the electrically conductive member 53. For example, the casing 10 may have a through-hole extending through the second end surface 12 and may include a cap attached to the through-hole, and a gear shaft may extend from the cap in the first direction.

Further, circumferential position and length of the detecting protrusion 521 may be different from the example illustrated in FIG. 4. Further, the detection gear 52 may include a plurality of detecting protrusions 521. The number of the detecting protrusions 521, position and length of each detecting protrusion 521 in the circumferential direction, and length of each detecting protrusion 521 in a radial direction may be changed corresponding to the specification of the developing cartridge 1. Various specifications of the developing cartridges 1 can be indicated to the image forming apparatus 100 by making variations in numbers and shapes of the detecting protrusion 521.

Further, the detection gear 52 may be constituted by a plurality of components. For example, the detection gear 52 may be a member separate from the detecting protrusion 521. Further, the detection gear may include a gear body and an auxiliary member whose position is changeable in accordance with rotation of the gear body. The auxiliary member may change the position of the lever. Further, the detection gear may include a gear body, a cam rotatable in accordance with rotation of the gear body, and a detecting protrusion displaceable in accordance with the rotation of the cam.

Further, the detection gear 52 may be a movable gear movable in the first direction upon its own rotation. In this case, the meshing engagement between the second agitator gear 51 and the detection gear 52 may be shut off by the movement of the detection gear 52 in the first direction. Further, a plurality of gear teeth may be provided throughout an entire outer circumferential surface of the detecting protrusion 521. The detection gear 52 may be moved in a direction away from the second end surface 12 or in a direction approaching the second end surface 12.

The second cover 54 is fixed to the second end surface 12 of the casing 10 by, for example screws. The second agitator gear 51, the detection gear 52, and the electrically conductive member 53 are accommodated between the second end surface 12 and the second cover 54. Specifically, the second cover 54 includes an inner surface facing the second end surface 12 in the first direction. The second agitator gear 51, the detection gear 52, and the electrically conductive member 53 are accommodated between the second end surface 12 and the inner surface of the second cover 54 in the first direction. The second cover 54 has an opening 541. A portion of the detecting protrusion 521 and a portion of the gear shaft 531 are exposed to the outside through the opening 541. The lever described above can be in contact with the detection gear 52 or the gear shaft 531 through the opening 541.

As illustrated in FIG. 4, the casing 10 further includes a second columnar protrusion 55. The second columnar protrusion 55 protrudes in the first direction from the second end surface 12 of the casing 10. The second columnar protrusion 55 is exposed to the outside through the second cover 54.

<3. IC Chip Assembly>

Figure 5:
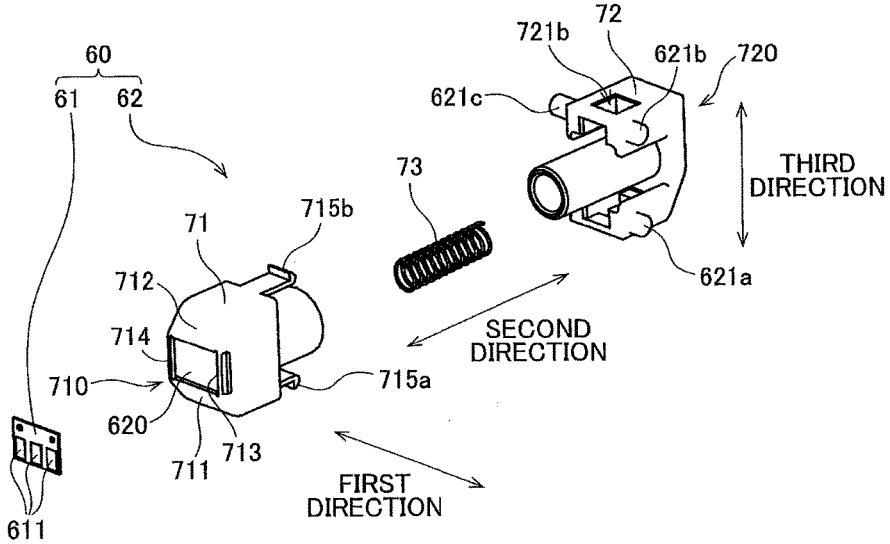
FIG. 5 is an exploded perspective view of an IC chip assembly in the image forming apparatus according to the embodiment.
Figure 6:
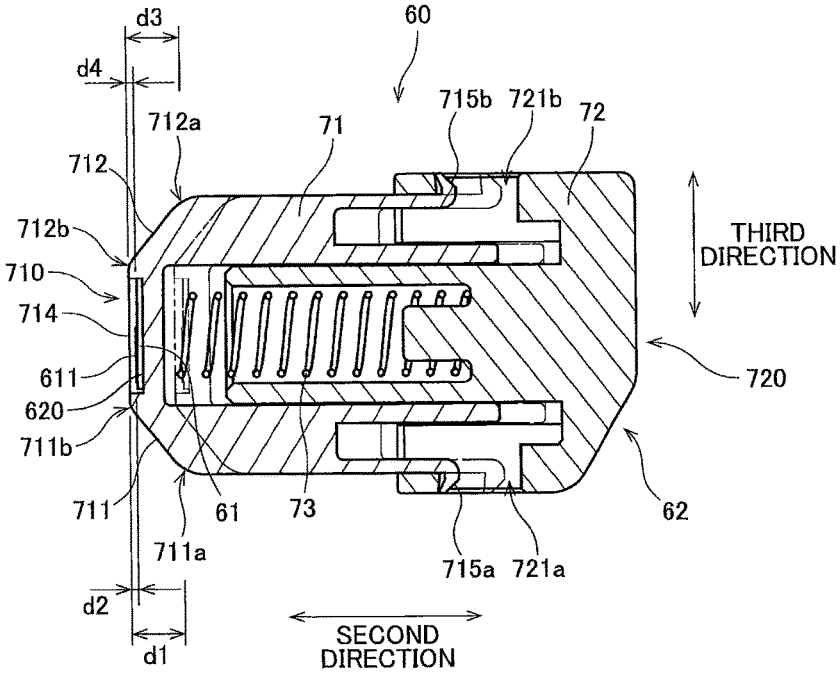
FIG. 6 is a cross-sectional view of the IC chip assembly.

The IC chip assembly 60 is positioned at an outside of the first end surface 11 of the casing 10. FIG. 5 is an exploded perspective view of the IC chip assembly 60. FIG. 6 is a cross-sectional view of the IC chip assembly 60 taken along a plane orthogonal to the first direction.

As illustrated in FIGS. 3 through 6, the IC chip assembly 60 includes the IC chip 61 as the storage medium, and the holder 62 holding the IC chip 61. The IC chip 61 is fixed to an outer surface of the holder 62. The IC chip 61 is held between the casing 10 and the first cover 45. The IC chip 61 includes an electrical contact surface 611 made from electrically conductive material such as metal. The IC chip 61 is configured to store various information as to the developing cartridge 1.

In the following description, a direction crossing the electrical contact surface 611 (in the present embodiment, a direction orthogonal to the electrical contact surface 611) will be referred to as "second direction." Further, the inserting direction of the developing cartridge 1 with respect to the slot 91 of the drawer unit 90 will be referred to as "third direction."

A portion of the holder 62 is covered by the first cover 45. The holder 62 includes a first boss 621*a*, a second boss 621*b*, and a third boss 621*c*. Each of the first boss 621*a* and the second boss 621*b* protrudes in the first direction toward the first cover 45 from one surface of the holder 62, the one surface being opposite to another surface of the holder 62 facing the casing 10. Further, the first boss 621*a* and the second boss 621*b* are arrayed in the third direction. On the other hand, as illustrated in FIG. 3, the first cover 45 has a first through-hole 451*a* and a second through-hole 451*b*. Each of the first through-hole 451*a* and the second through-hole 451*b* extends through the first cover 45 in the first direction. The first through-hole 451*a* and the second through-hole 451*b* are arrayed in the third direction. The first boss 621*a* and the second boss 621*b* are inserted into the first through-hole 451*a* and the second through-hole 451*b*, respectively.

The third boss 621*c* protrudes in the first direction toward the casing 10 from the other surface of the holder 62 facing the casing 10. On the other hand, the casing 10 further has a recessed portion 15. The recessed portion 15 is positioned at the first end surface 11 and is recessed in the first direction. The third boss 621*c* is inserted into the recessed portion 15. Incidentally, any shape such as solid cylinder and prismatic column may be employed as each of shape of the first boss 621*a*, the second boss 621*b*, and the third boss 621*c*.

The first through-hole 451*a* has a dimension (inner dimension) in the second direction greater than a dimension (outer dimension) in the second direction of the first boss 621*a*. Further, the second through-hole 451*b* has a dimension (inner dimension) in the second direction greater than a dimension (outer dimension) in the second direction of the second boss 621*b*. Further, the recessed portion 15 has a dimension (inner dimension) in the second direction greater than a dimension (outer dimension) in the second direction of the third boss 621*c*. Therefore, the holder 62 is movable in the second direction, together with the first boss 621*a*, the second boss 621*b*, and the third boss 621*c*, relative to both the casing 10 and the first cover 45. The IC chip 61 including the electrical contact surface 611 is also moved in the second direction together with the holder 62 upon the movement of the holder 62 in the second direction.

Further, the first through-hole 451*a* has a dimension (inner dimension) in the third direction greater than a dimension (outer dimension) in the third direction of the first boss 621*a*. Further, the second through-hole 451*b* has a dimension (inner dimension) in the third direction greater than a dimension (outer dimension) in the third direction of the second boss 621*b*. Further, the recessed portion 15 has a dimension (inner dimension) in the third direction greater than a dimension (outer dimension) in the third direction of the third boss 621*c*. Therefore, the holder 62 is movable in the third direction, together with the first boss 621*a*, the second boss 621*b*, and the third boss 621*c*, relative to both the casing 10 and the first cover 45. The IC chip 61 including the electrical contact surface 611 is also moved in the third direction together with the holder 62 upon the movement of the holder 62 in the third direction.

Incidentally, the holder 62 may be movable in the first direction between the first end surface 11 of the casing 10 and the first cover 45. Specifically, the holder 62 may be movable in the first direction between the first end surface 11 of the casing 10 and the inner surface of the first cover 45. Further, the number of the bosses of the holder 62, the number of through-holes of the first cover 45, and the number of recessed portions of the casing 10 are not limited to those numbers according to the embodiment. Further, the first cover 45 may have recessed portions instead of the through-holes. In this case, the bosses may be inserted into the recessed portions of the first cover 45.

As illustrated in FIGS. 5 and 6, The holder 62 includes a first outer surface 710 and a second outer surface 720. The first outer surface 710 is positioned at one end portion of the holder 62 in the second direction. The second outer surface 720 is positioned at the other end portion of the holder 62 in the second direction. The second outer surface 720 is movable in the second direction with respect to the first outer surface 710.

More specifically, the holder 62 includes a first holder member 71, a second holder member 72, and a coil spring 73 positioned between the first holder member 71 and the second holder member 72. For example, the first holder member 71 and the second holder member 72 are made from resin. The first holder member 71 includes the first outer surface 710 including a holding surface 620 to which the IC chip 61 is fixed. The second holder member 72 includes the second outer surface 720. In a state where the holder 62 is assembled, the second outer surface 720 is spaced away from the first outer surface 710 in the second direction.

The coil spring 73 is an elastic member extending in the second direction. The coil spring 73 is positioned between the first outer surface 710 and the second outer surface 720 in the second direction. The coil spring 73 is expandable and contractible in the second direction at least between a first state and a second state. Contraction of the coil spring 73 in the second state is greater than that in the first state. Length in the second direction of the coil spring 73 in the first state is longer than that in the second state. Therefore, a distance between the first outer surface 710 and the second outer surface 720 in the second direction in the first state is longer than that in the second state. Further, at least the length in the second direction of the coil spring 73 in the second state is shorter than a natural length of the coil spring 73.

Further, as illustrated in FIGS. 5 and 6, the first holder member 71 includes a first pawl portion 715*a* and a second pawl portion 715*b*. Each of the first pawl portion 715*a* and the second pawl portion 715*b* protrudes from the first holder member 71 in a direction crossing the second direction. On the other hand, the second holder member 72 has a first opening 721*a* and a second opening 721*b*. The first pawl portion 715*a* and the second pawl portion 715*b* are inserted into the first opening 721*a* and the second opening 721*b*, respectively. The first opening 721*a* includes one edge and the other edge in the second direction, and the one edge is positioned closer to the first outer surface 710 than the other edge is to the first outer surface 710. In the first state of the coil spring 73, the first pawl portion 715*a* is in contact with the second holder member 72 at the one edge of the first opening 721*a*. The second opening 721*b* includes one edge and the other edge in the second direction, and the one edge is positioned closer to the first outer surface 710 than the other edge is to the first outer surface 710. In the first state of the coil spring 73, the second pawl portion 715*b* is in contact with the second holder member 72 at the one edge of the second opening 721*b*. Thus, the length in the second direction of the coil spring 73 is prevented from becoming longer than the length in the second direction of the coil spring 73 in the first state. Further, the first holder member 71 is prevented from being detached from the second holder member 72. On the other hand, in the second state of the coil spring 73, each of the first pawl portion 715*a* and the second pawl portion 715*b* is separated from the second holder member 72.

Incidentally, the second holder member 72 may have recessed portions configured to contact pawl portions or stepped portion configured to contact pawl portions, instead of the openings. Further, the first holder member 71 may have openings, recessed portions or stepped portions, and the second holder member 72 may include pawl portions.

The holding surface 620 of the holder 62 can move in the second direction relative to the casing 10 by virtue of dimensional difference between the first through-hole 451*a* and the first boss 621*a*, dimensional difference between the second through-hole 451*b* and the second boss 621*b*, dimensional difference between the recessed portion 15 and the third boss 621*c*, and expansion and contraction of the coil spring 73.

In the following description, a position in the second direction of the holding surface 620 relative to the casing 10 prior to attachment of the developing cartridge 1 to the drawer unit 90 will be referred to as "initial position". Further, a position in the second direction of the holding surface 620 relative to the casing 10 at a most contracting timing of the coil spring 73 during attachment of the developing cartridge 1 to the drawer unit 90 will be referred to as "intermediate position." Incidentally, the most contracting timing is a timing when the coil spring 73 is most contracted during attachment of the developing cartridge 1 to the drawer unit 90. Further, a position in the second direction of the holding surface 620 relative to the casing 10 when the electrical contact surface 611 is brought into contact with a terminal portion 913 (described later) will be referred to as "contacting position." Further, a position in the second direction of the holding surface 620 relative to the casing 10 after completion of attachment of the developing cartridge 1 to the drawer unit 90 will be referred to as "terminal position."

The first outer surface 710 further includes a first surface 711, a second surface 712, a third surface 713, and a fourth surface 714 in addition to the holding surface 620. The first outer surface 710 includes one side portion and the other side portion in the third direction. The one side portion and the other side portion are positioned on opposite sides of the holding surface 620 in the third direction. The one side portion is positioned closer to the developing roller 30 than the other side portion is to the developing roller 30. The other side portion is positioned farther from the developing roller 30 than the one side portion is from the developing roller 30.

The first surface 711 is positioned at the one side portion of the first outer surface 710. The first surface 711 is inclined with respect to the electrical contact surface 611 of the IC chip 61 held by the holding surface 620.

Here, one end of the first outer surface 710 in the third direction will be referred to as a first outer edge position 711*a*. Further, one end of the holding surface 620 in the third direction will be referred to as a first inner edge position 711*b*. As illustrated in FIG. 6, the first surface 711 extends from the first outer edge position 711*a* to the first inner edge position 711*b* toward the electrical contact surface 611. The first outer edge position 711*a* is positioned farther from the electrical contact surface 611 than the first inner edge position 711*b* is from the electrical contact surface 611 in the second direction and the third direction. Further, a distance d1 in the second direction between the first outer edge position 711*a* and the first inner edge position 711*b* is greater than a distance d2 in the second direction between the electrical contact surface 611 and the first inner edge position 711*b*.

The second surface 712 is positioned at the other side portion of the first outer surface 710. The second surface 712 is inclined with respect to the electrical contact surface 611 of the IC chip 61 held by the holding surface 620.

Here, the other end of the first outer surface 710 in the third direction will be referred to as a second outer edge position 712*a*. Further, the other end of the holding surface 620 in the third direction will be referred to as a second inner edge position 712*b*. As illustrated in FIG. 6, the second surface 712 extends from the second outer edge position 712*a* to the second inner edge position 712*b* toward the electrical contact surface 611. The second outer edge position 712*a* is positioned farther from the electrical contact surface 611 than the second inner edge position 712*b* is from the electrical contact surface 611 in the second direction and the third direction. Further, a distance d3 in the second direction between the second outer edge position 712*a* and the second inner edge position 712*b* is greater than a distance d4 in the second direction between the electrical contact surface 611 and the second inner edge position 712*b*.

The third surface 713 and the fourth surface 714 are positioned adjacent to the electrical contact surface 611 in the first direction. More specifically, The third surface 713 and the fourth surface 714 are provided at both sides of the electrical contact surface 611 in the first direction. The third surface 713 is positioned opposite to the fourth surface 714 with respect to the electrical contact surface 611. The third surface 713 is positioned closer to the casing 10 than the fourth surface 714 is to the casing 10. Each of the third surface 713 and the fourth surface 714 extends in the third direction. The electrical contact surface 611 is positioned at a recessed position recessed toward the coil spring 73. That is, the third surface 713 and the fourth surface 714 are positioned farther from the coil spring 73 than the electrical contact surface 611 is from the coil spring 73 in the second direction.

Incidentally, the first surface 711, the second surface 712, the third surface 713, and the fourth surface 714 may be flat surfaces or curved surfaces. Each of the first surface 711, the second surface 712, the third surface 713, and the fourth surface 714 is preferably a smooth surface without any stepped portion so as to prevent any catching during insertion of the developing cartridge 1 to the drawer unit 90.

<4. Drawer Unit>

Figure 7:
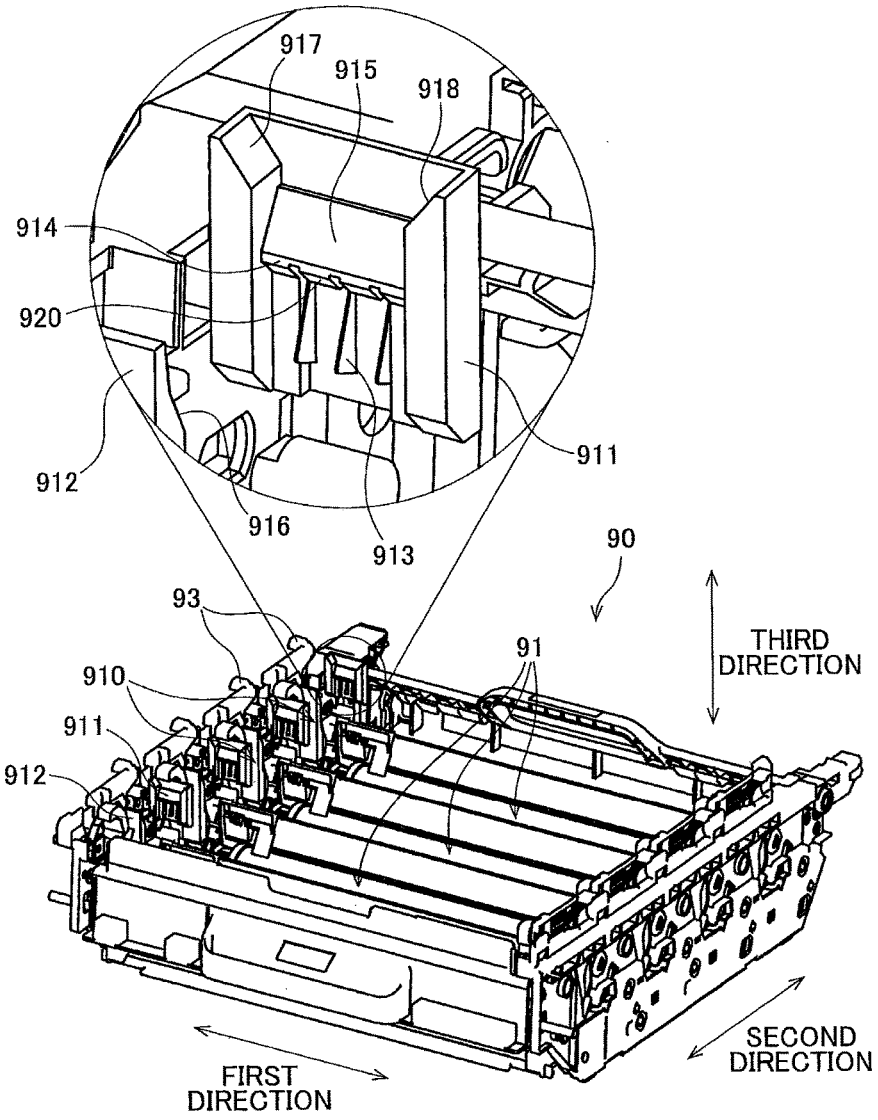
FIG. 7 is a perspective view of a drawer unit in the image forming apparatus according to the embodiment.

FIG. 7 is a perspective view of drawer unit 90. As described above, the drawer unit 90 includes four slots 91 to which the developing cartridges 1 are attachable. Each of the four slots 91 has one end portion and the other end portion in the third direction, and the one end portion is farther from the photosensitive drum 92 than the other end portion is from the photosensitive drum 92. Each of the four slots 91 has an insertion opening 910. The insertion opening 910 is positioned at the one end portion of the slot 91 in the third direction. Further, each of the four slots 91 includes a first guide plate 911 and a second guide plate 912. The first guide plate 911 and the second guide plate 912 are positioned at one end portion of each of the four slots 91 in the first direction.

Figure 8:
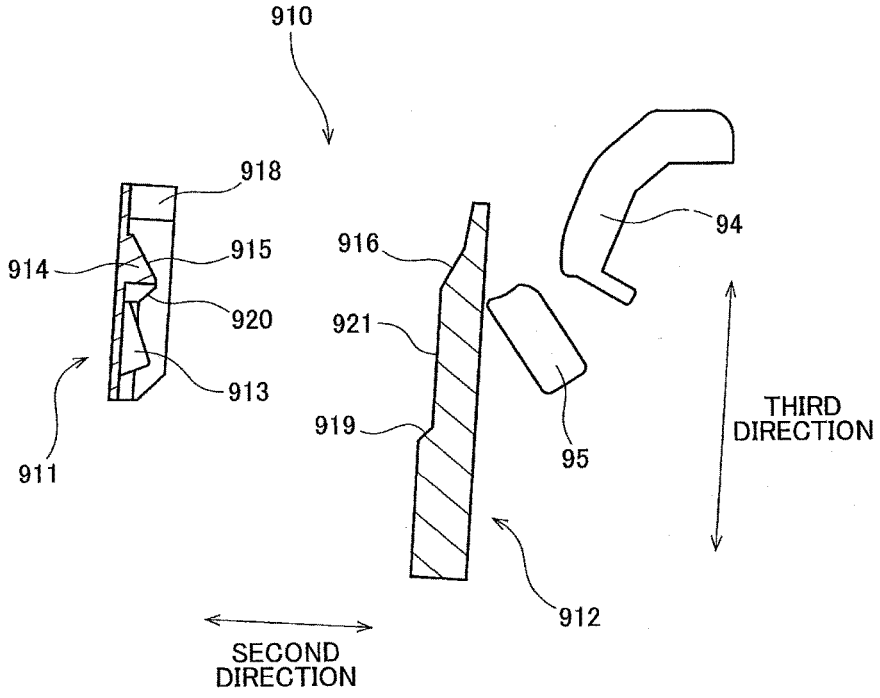
FIG. 8 is a cross-sectional view of a first guide plate and a second guide plate in the image forming apparatus according to the embodiment.

FIG. 8 is a cross-sectional view of the first guide plate 911 and the second guide plate 912 taken along a plane orthogonal to the first direction. As illustrated in FIGS. 7 and 8, the first guide plate 911 and the second guide plate 912 are positioned in facing relation to each other in the second direction with a space between the first guide plate 911 and the second guide plate 912. Each of the first guide plate 911 and the second guide plate 912 extends in the first direction and the third direction.

The first guide plate 911 includes the terminal portion 913. The terminal portion 913 is an electrical contact contactable with the electrical contact surface 611 of the IC chip 61. The terminal portion 913 is farther from the insertion opening 910 than a guide protrusion 914 (described later) is from the insertion opening 910. The terminal portion 913 protrudes in the second direction toward the second guide plate 912 from a surface of the first guide plate 911. The terminal portion 913 is configured to be electrically connected to the controller 80 of the image forming apparatus 100. For example, the terminal portion 913 is made from electrically conductive material such as metal.

As illustrated in an enlarged view of FIG. 7 and FIG. 8, the first guide plate 911 further includes the guide protrusion 914 positioned closer to the insertion opening 910 than the terminal portion 913 is to the insertion opening 910. Further, the guide protrusion 914 protrudes toward the second guide plate 912 from the first guide plate 911. The first guide plate 911 includes a first guide surface 915. In the example of FIG. 8, a sloped surface of the guide protrusion 914 facing the insertion opening 910 in the third direction serves as the first guide surface 915. More specifically, in the example of FIG. 8, the guide protrusion 914 includes two sloped surfaces inclined with respect to the third direction. In the two sloped surfaces, one sloped surface is positioned closer to the insertion opening 910 than the other sloped surface is to the insertion opening 910, and the other surface is positioned closer to the terminal portion 913 than the one sloped surface is to the terminal portion 913. The one sloped surface of the guide protrusion 914 constitutes the first guide surface 915.

On the other hand, the second guide plate 912 includes a second guide surface 916. The first guide surface 915 and the second guide surface 916 are spaced away from each other in the second direction. Further, a gap distance between the first guide surface 915 and the second guide surface 916 in the second direction is gradually reduced from a first gap distance to a second gap distance in the third direction toward the photosensitive drum 92.

In a case where the developing cartridge 1 is inserted into the drawer unit 90, the first outer surface 710 of the holder 62 is brought into contact with the first guide surface 915 and the second outer surface 720 of the holder 62 is brought into contact with the second guide surface 916. Accordingly, the distance between the first outer surface 710 and the second outer surface 720 in the second direction is changed.

Further, the second guide plate 912 includes a supporting surface 921. The supporting surface 921 is positioned closer to the photosensitive drum 92 than the second guide surface 916 is to the photosensitive drum 92. The terminal portion 913 and the supporting surface 921 face each other in the second direction. Further a gap distance between the terminal portion 913 and the supporting surface 921 is greater than the second gap distance. The second outer surface 720 of the holder 62 is in contact with the supporting surface 921 after insertion of the developing cartridge 1 into the drawer unit 90.

Further, the first guide plate 911 further includes a third guide surface 917 and a fourth guide surface 918 as illustrated in FIGS. 7 and 8. The third guide surface 917 and the fourth guide surface 918 perform positioning of the holder 62 in the first direction at the time of insertion of the developing cartridge 1 into the drawer unit 90. The third guide surface 917 and the fourth guide surface 918 are positioned closer to the insertion opening 910 than the terminal portion 913 and the guide protrusion 914 are to the insertion opening 910. Further, the third guide surface 917 and the fourth guide surface 918 are spaced away from each other in the first direction. Further, a gap distance between the third guide surface 917 and the fourth guide surface 918 in the first direction is gradually reduced toward the first guide surface 915.

As illustrated in FIG. 8, the second guide plate 912 further includes a stop surface 919. The stop surface 919 is configured to restrict movement of the holder 62 toward the photosensitive drum 92 after the developing cartridge 1 is inserted into the drawer unit 90. The stop surface 919 is positioned closer to the photosensitive drum 92 than the supporting surface 921 is to the photosensitive drum 92. That is, the stop surface 919 is positioned farther from the insertion opening 910 than the supporting surface 921 and the terminal portion 913 are from the insertion opening 910. Further, the stop surface 919 is positioned at a surface of the second guide plate 912 facing the first guide plate 911, and extends from the supporting surface 921 toward the first guide plate 911. In the example illustrated in FIG. 8, the stop surface 919 extends in the second direction and the third direction, and is inclined with respect to the second direction and the third direction. A portion of the holder 62 faces the stop surface 919 in the third direction after insertion of the developing cartridge 1 into the drawer unit 90.

Incidentally, the stop surface may be provided at at least one of the first guide plate 911 and the second guide plate 912. That is, the first guide plate 911 may include a stop surface. In this case, the stop surface is positioned closer to the photosensitive drum 92 than the terminal portion 913 is to the photosensitive drum 92. Further, the stop surface is positioned at a surface of the first guide plate 911 facing the second guide plate 912, and extends from the surface toward the second guide plate 912.

The first guide plate 911 further includes a fifth guide surface 920. The fifth guide surface 920 is configured to restrict movement of the holder 62 toward the insertion opening 910 after insertion of the developing cartridge 1 into the drawer unit 90. The fifth guide surface 920 is positioned between the terminal portion 913 and the first guide surface 915 in the third direction. That is, the fifth guide surface 920 is positioned closer to the insertion opening 910 than the terminal portion 913 is to the insertion opening 910. Further, the fifth guide surface 920 is farther from the insertion opening 910 than the first guide surface 915 is from the insertion opening 910. A portion of the holder 62 faces the fifth guide surface 920 in the third direction after insertion of the developing cartridge 1 into the drawer unit 90.

In the example of FIG. 8, a sloped surface of the guide protrusion 914 facing the terminal portion 913 in the third direction serves as the fifth guide surface 920. More specifically, in the two sloped surfaces of the guide protrusion 914, the other sloped surface constitutes the fifth guide surface 920. However, the fifth guide surface 920 may be provided at at least one of the first guide plate 911 and the second guide plate 912.

The drawer unit 90 further includes a plurality of separation lever 93 as illustrated in FIG. 7, and a plurality of pressure members 94 and a plurality of urging members 95 as illustrated in FIG. 8. The pressure member 94 and the urging member 95 are provided at each of side end portions of each of slots 91 in the first direction. The first columnar protrusion 46 is positioned between the pressure member 94 and the urging member 95 at one side end portion of the slot 91 in the first direction after attachment of the developing cartridge 1 to the drawer unit 90. Further, the second columnar protrusion 55 is positioned between the pressure member 94 and the urging member 95 at the other side end portion of the slot 91 in the first direction. The pressure member 94 positioned at the one side end portion of the slot 91 is configured to press the first columnar protrusion 46 in the third direction toward the photosensitive drum 92. The pressure member 94 positioned at the other side end portion of the slot 91 is configured to press the second columnar protrusion 55 in the third direction toward the photosensitive drum 92.

The urging member 95 is operated in interlocking relation to the separation lever 93. At the time of separating operation described later, the separation lever 93 is pushed by the driving force from the main body of the image forming apparatus 100. Then, each of the urging members 95 corresponding to the pushed separation lever 93 is moved in the third direction toward the corresponding pressure member 94. Thus, each of the first columnar protrusion 46 and the second columnar protrusion 55 is urged by the corresponding urging members 95, and is moved against the pressure of the corresponding pressure member 94. As a result, the casing 10 of the developing cartridge 1 and the developing roller 30 are moved in the third direction.

<5. Attaching Operation>

Next operation for attachment of the developing cartridge 1 to the drawer unit 90 will be described with reference to FIGS. 9 through 15. In these drawings, attachment states of one developing cartridge 1 to one slot 91 are illustrated.

Figure 9:
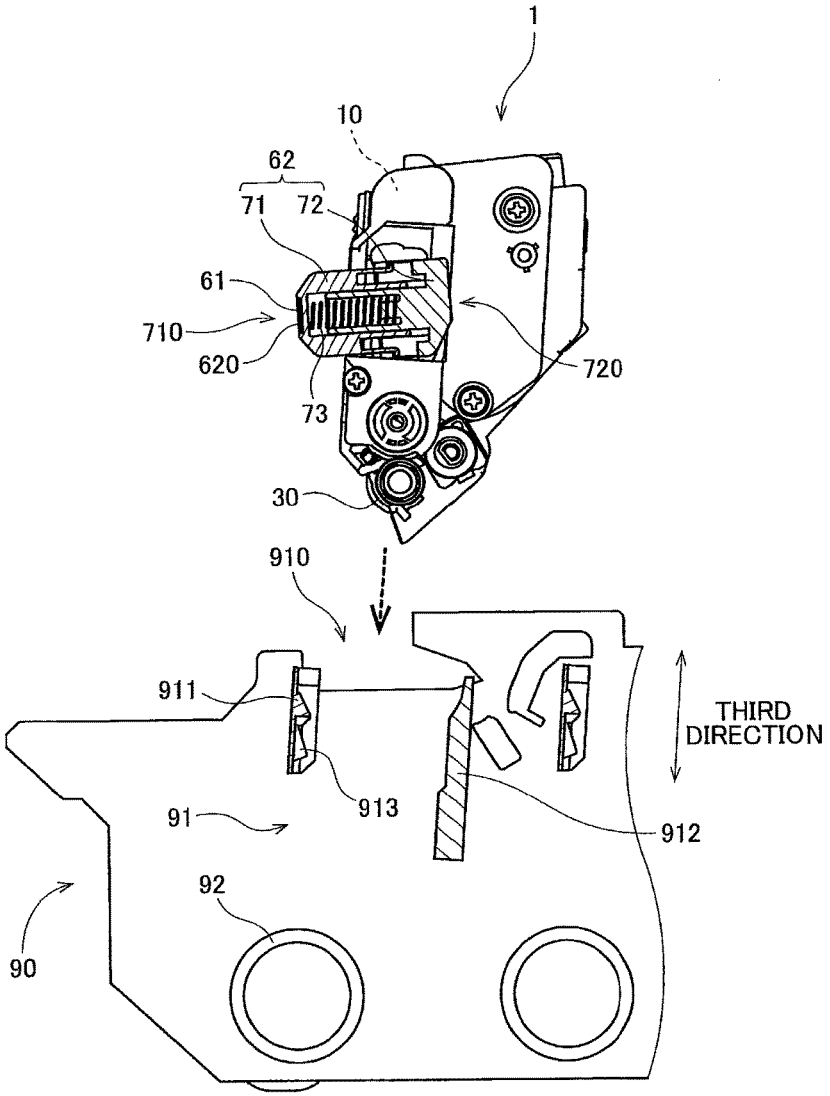
FIG. 9 is a view for description of attachment of the developing cartridge.

As illustrated in FIG. 9, for attaching the developing cartridge 1 to the slot 91, the developing cartridge 1 is first placed at a position facing the insertion opening 910. In this case, the first outer surface 710 and the second outer surface 720 of the holder 62 are out of contact with the drawer unit 90. Therefore, the coil spring 73 is at the first state described later. Further, the position of the holding surface 620 in the second direction with respect to the casing 10 is the "initial position." The developing cartridge 1 will be inserted into the insertion opening 910 in the third direction as indicated by a dashed arrow in FIG. 9.

Figure 10:
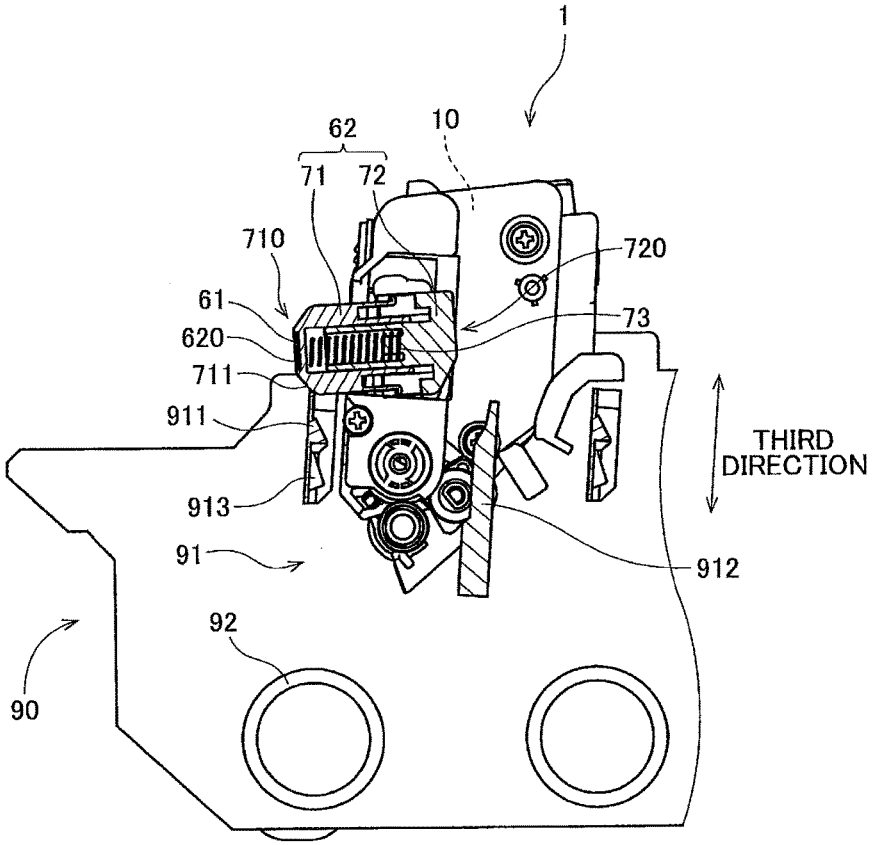
FIG. 10 is a view for description of attachment of the developing cartridge.

Then, in a case where the developing cartridge 1 starts to be inserted into the slot 91, the first surface 711 of the holder 62 is brought into contact with the end in the third direction of the first guide plate 911. Subsequently, the holder 62 is moved in the second direction because the first surface 711 is pressed by the first guide plate 911 as illustrated in FIG. 10. This movement of the holder 62 is the relative movement of the holder 62 with respect to the casing 10. With this operation, the holder 62 is subject to positioning in the second direction between the first guide plate 911 and the second guide plate 912.

Further, a portion of the holder 62 is inserted between the third guide surface 917 and the fourth guide surface 918 in the third direction, while the portion of the holder 62 is in contact with the third guide surface 917 and the fourth guide surface 918. Accordingly, the holder 62 is subject to positioning in the first direction. In this way, according to the present embodiment, the holder 62 is subjected to positioning in the first direction prior to the contact of the electrical contact surface 611 with the terminal portion 913. Thus, after contact of the electrical contact surface 611 with the terminal portion 913, displacement of the electrical contact surface 611 in the first direction with respect to the terminal portion 913 can be restrained. Consequently, frictional wearing of the electrical contact surface 611 can be restrained.

Figure 11:
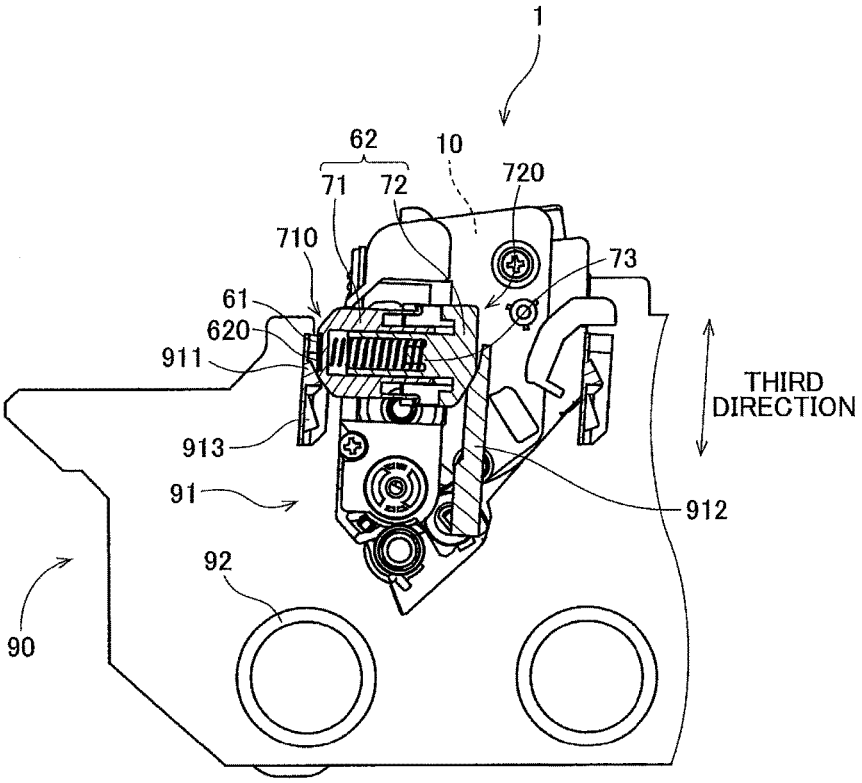
FIG. 11 is a view for description of attachment of the developing cartridge.

Then, as illustrated in FIG. 11, the first outer surface 710 of the first holder member 71 is brought into contact with the first guide plate 911, and the first outer surface 710 is moved in the third direction along the surface of the first guide plate 911. Further, the second outer surface 720 of the second holder member 72 is brought into contact with the second guide plate 912, and the second outer surface 720 is moved in the third direction along the surface of the second guide plate 912. The coil spring 73 is further contracted in the second direction in comparison with the first state.

In a case where the developing cartridge 1 is further inserted in the third direction, the holder 62 is inserted between the first guide surface 915 and the second guide surface 916. By this further insertion of the holder 62, the first holder member 71 is brought into contact with the first guide surface 915, and the second holder member 72 is brought into contact with the second guide surface 916. More specifically, the first surface 711, the third surface 713, and the fourth surface 714 of the first outer surface 710 are brought into contact with the first guide surface 915, and the second outer surface 720 is brought into contact with the second guide surface 916. Accordingly, the first holder member 71 and the second holder member 72 approach each other in the second direction. That is, the distance in the second direction between the first outer surface 710 and the second outer surface 720 is gradually reduced. Hence, the length of the coil spring 73 in the second direction is gradually reduced.

Figure 12:
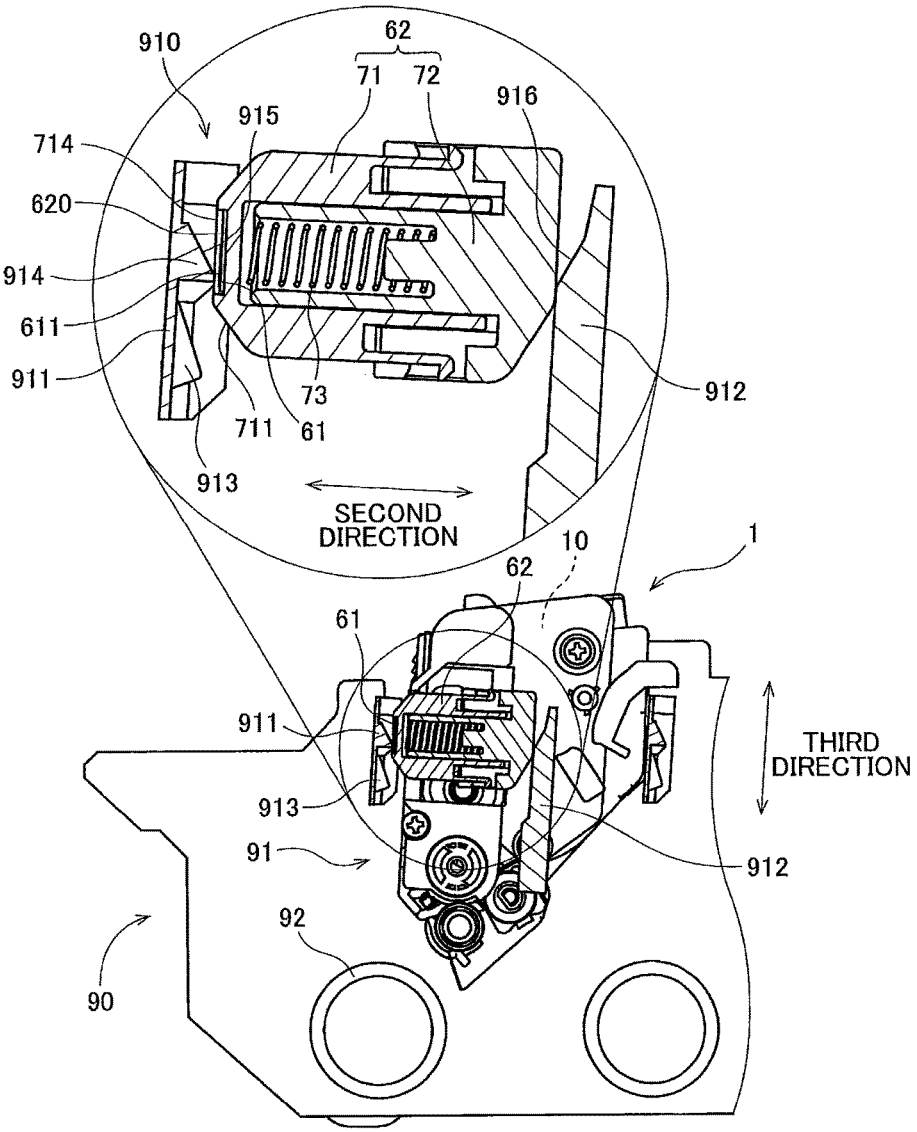
FIG. 12 is a view for description of attachment of the developing cartridge.

Then, as illustrated in FIG. 12, the third surface 713 and the fourth surface 714 of the first holder member 71 contact an apex of the guide protrusion 914. Hence, the length of the coil spring 73 in the second direction becomes a minimum length, that is, the coil spring 73 is brought into a minimum state in which the length of the coil spring 73 in the second direction is smaller than that in the second state. Further, the position of the holding surface 620 in the second direction with respect to the casing 10 becomes the "intermediate position" described above.

In this way, the IC chip assembly 60 is capable of changing the position of the holding surface 620 holding the IC chip 61 in the second direction during insertion of the developing cartridge 1 into the drawer unit 90. Therefore, the developing cartridge 1 can be inserted into the slot 91 while changing the position of the holding surface 620 in the second direction along the guide protrusion 914. Accordingly, the developing cartridge 1 can be inserted into the drawer unit 90 while restraining frictional wearing of the electrical contact surface 611 of the IC chip 61.

Particularly, in the developing cartridge 1 according to the present embodiment, on the first outer surface 710, the electrical contact surface 611 of the IC chip 61 is positioned at a recessed position recessed in the second direction. Therefore, in the state illustrated in FIG. 12, the apex of the guide protrusion 914 does not contact the electrical contact surface 611 but only contacts the third surface 713 and the fourth surface 714. Thus, frictional sliding of the guide protrusion 914 against the electrical contact surface 611 can be prevented.

Figure 13:
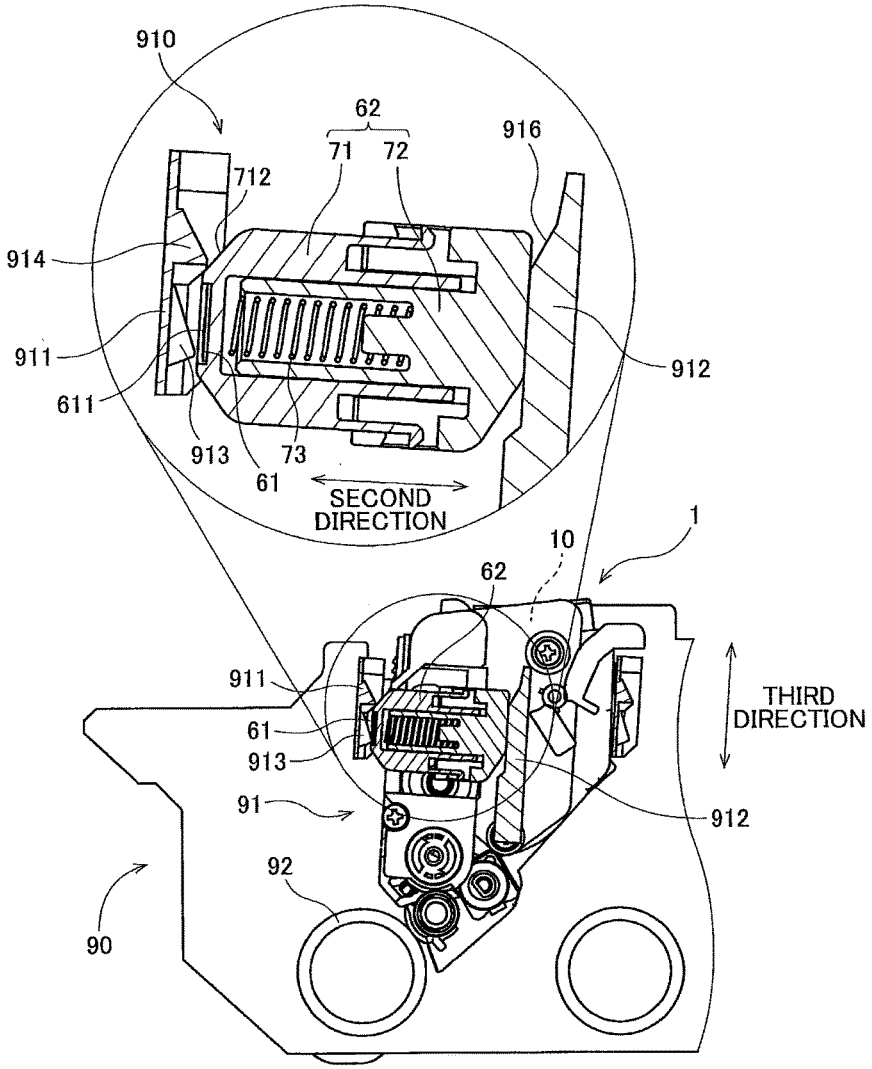
FIG. 13 is a view for description of attachment of the developing cartridge.
Figure 14:
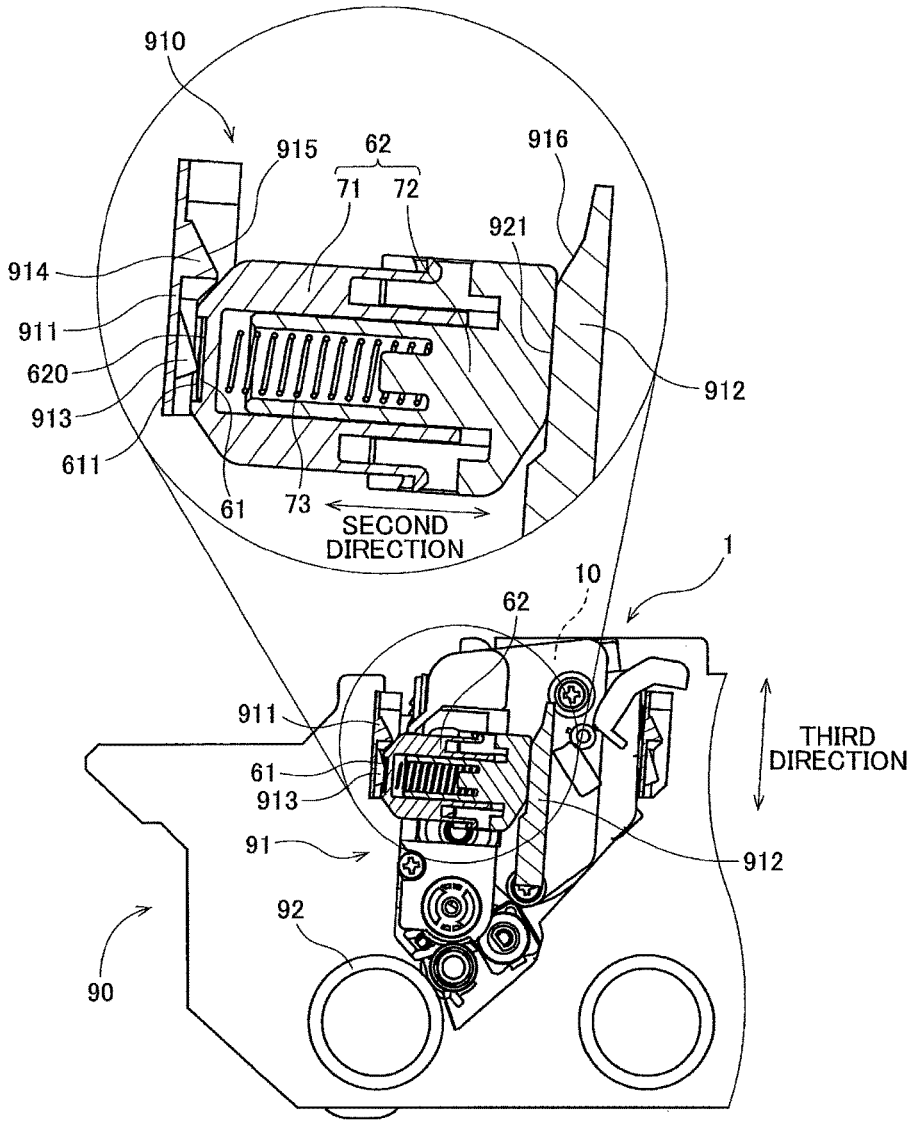
FIG. 14 is a view for description of attachment of the developing cartridge.

Then, in a case where the developing cartridge 1 is further inserted in the third direction, the third surface 713 and the fourth surface 714 are moved past the guide protrusion 914. Then as illustrated in FIG. 13, the second surface 712 is brought into contact with the guide protrusion 914. Accordingly, the coil spring 73 is again expanded from the minimum state, so that the coil spring 73 becomes the second state described above. As a result, the electrical contact surface 611 of the IC chip 61 is brought into contact with the terminal portion 913 as illustrated in FIG. 14. Consequently, the controller 80 of the image forming apparatus 100 can perform at least one of reading information from the IC chip 61 and writing information into the IC chip 61. In this case, the second outer surface 720 of the holder 62 is in contact with the supporting surface 921 of the second guide plate 912.

The length of the coil spring 73 in the second direction in the second state is shorter than the length of the coil spring 73 in the second direction in the first state. The length of the coil spring 73 in the second direction in the second state is longer than the length of the coil spring 73 in the second direction in the minimum state. Further, the position of the holding surface 620 in the second direction with respect to the casing 10 becomes the "contacting position" described above.

As described above, the first outer surface 710 contacts the first guide surface 915 and then moves past the guide protrusion 914 while the position of the first outer surface 710 in the second direction is changed. After the first outer surface 710 moves past the guide protrusion 914, the electrical contact surface 611 is brought into contact with the terminal portion 913. Therefore, contact position between the electrical contact surface 611 and the terminal portion 913 is hardly changed. As a result, frictional wearing of the electrical contact surface 611 can further be reduced.

A distance in the second direction between the terminal portion 913 and the supporting surface 921 is smaller than the distance in the second direction between the electrical contact surface 611 and the second outer surface 720 prior to the attachment of the developing cartridge 1. Therefore, in the state illustrated in FIG. 14, the length of the coil spring 73 in the second direction is smaller than its natural length. As a result, the electrical contact surface 611 is urged against the terminal portion 913 because of the elastic force (restoring force) of the coil spring 73. Thus, contact between the electrical contact surface 611 and the terminal portion 913 can be satisfactorily maintained.

The IC chip assembly 60 is fixed while being nipped between the terminal portion 913 and the supporting surface 921. Thereafter, in the present embodiment, the casing 10 is tilted in the second direction as indicated by a dashed arrow in FIG. 15. As a result, the developing roller 30 is brought into contact with the photosensitive drum 92 of the drawer unit 90. In this instance, the position of the holding surface 620 in the second direction with respect to the casing 10 is changed from the "contacting position" to the "terminal position". Further, the first boss 621*a* and the second boss 621*b* are moved in the second direction within the first through-hole 451*a* and the second through-hole 451*b*, respectively. Further, the third boss 621*c* is moved in the second direction within the recessed portion 15. As a result of these movements, the holder 62 becomes out of contact with the casing 10 and the first cover 45. Consequently, transmission of vibration from the driving portion such as the first gear portion 40 to the IC chip assembly 60 can be restrained during image forming process executed in the image forming apparatus 100. Thus, the contacting state between the electrical contact surface 611 and the terminal portion 913 can be more satisfactorily maintained.

<6. Separating Operation>

In the image forming apparatus 100, separating operation for temporarily separating the developing roller 30 from the photosensitive drum 92 can be performed after attachment of the developing cartridge 1.

Figure 15:
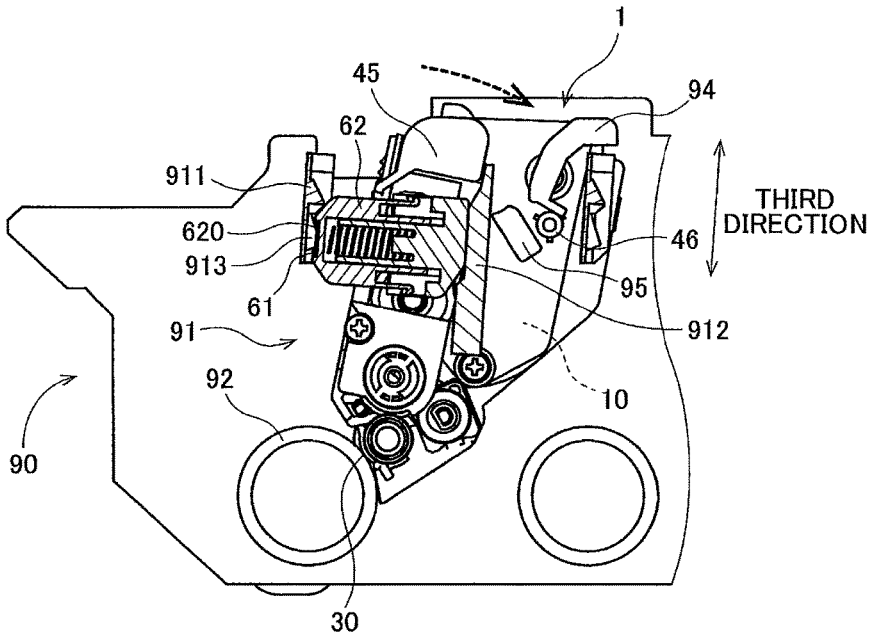
FIG. 15 is a view for description of attachment of the developing cartridge.

Upon completion of tilting operation as indicated by the dashed arrow in FIG. 15, each of the first columnar protrusion 46 and the second columnar protrusion 55 is brought into contact with the corresponding pressure member 94. Each of the first columnar protrusion 46 and the second columnar protrusion 55 is urged toward the photosensitive drum 92 by the corresponding pressure members 94. Therefore, the developing roller 30 is pressed against the photosensitive drum 92. That is, the developing roller 30 and the photosensitive drum 92 are maintained in a contacting state where the developing roller 30 and the photosensitive drum 92 are in contact with each other.

Figure 16:
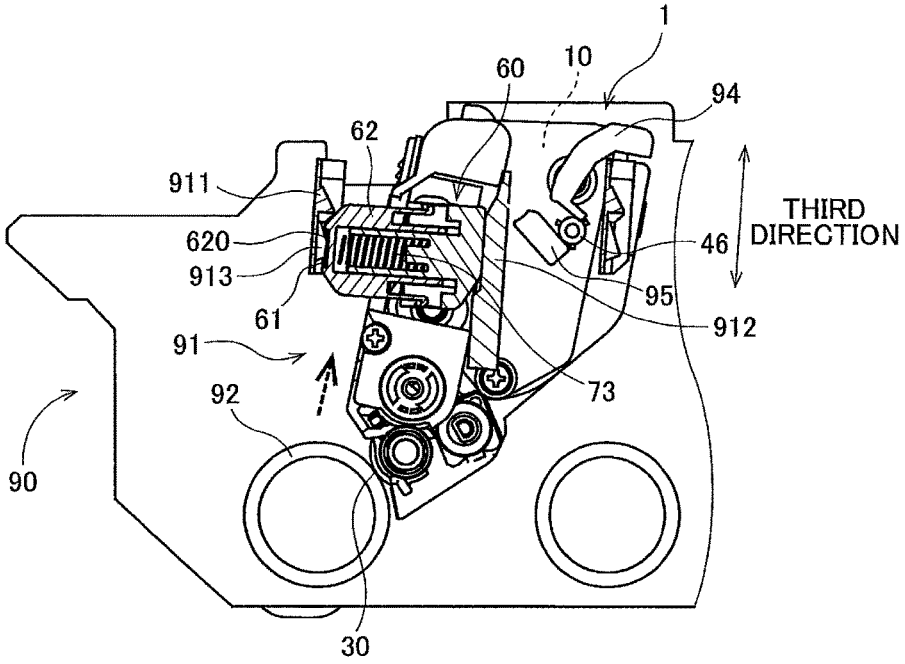
FIG. 16 is a view for description of separating operation.

FIG. 16 is a view of the developing cartridge 1 and the drawer unit 90 in a state where the separating operation is performed. In the separating operation, the separation lever 93 is pressed by the driving force from the main body of the image forming apparatus 100. Upon the separation lever 93 being pressed, the urging member 95 is moved in the third direction toward the pressure member 94. By this movement, the urging member 95 positioned at the one side end portion of the slot 91 in the first direction is brought into contact with the first columnar protrusion 46 and moves the first columnar protrusion 46 toward the insertion opening 910 against the pressure from the pressure member 94. Further, the urging member 95 positioned at the other side end portion of the slot 91 in the first direction is brought into contact with the second columnar protrusion 55 and moves the second columnar protrusion 55 toward the insertion opening 910 against the pressure from the pressure member 94. As a result, the casing 10 of the developing cartridge 1 and the developing roller 30 are moved in the third direction as indicated by a dashed arrow in FIG. 16, so that the developing roller 30 and the photosensitive drum 92 are brought into a separating state where the developing roller 30 and the photosensitive drum 92 are separated from each other.

In both the contacting state and the separating state, the IC chip assembly 60 is fixed while being nipped between the terminal portion 913 and the supporting surface 921, and the electrical contact surface 611 is in contact with the terminal portion 913. The holder 62 is out of contact with the casing 10 and the first cover 45. Further, the first guide plate 911 and the second guide plate 912 are out of contact with the casing 10 and the first cover 45. Therefore, during the separating operation, the casing 10 can be moved with respect to the holder 62 while the holder 62 is fixed between the first guide plate 911 and the second guide plate 912.

In other words, during the separating operation, while the casing 10 and the developing roller 30 are moved in the third direction, the position of the IC chip assembly 60 with respect to the drawer unit 90 is unchanged. Further, the coil spring 73 remains unchanged and maintained at the second state. That is, the position of the casing 10 in the third direction is changed while the position of the electrical contact surface 611 with respect to the drawer unit 90 is fixed. Therefore, contacting state between the electrical contact surface 611 and the terminal portion 913 can be maintained, and frictional wearing of the electrical contact surface 611 during separating operation can be restrained.

Further, in the state where the developing cartridge 1 is attached to the drawer unit 90, the contacting state between the electrical contact surface 611 and the terminal portion 913 can be maintained during transportation of the image forming apparatus 100. Thus, frictional wearing of the electrical contact surface 611 can be further restrained.

Incidentally, according to the above-described embodiment, the separating direction where the developing roller 30 is separated from the photosensitive drum 92 during the separating operation is the third direction. However, the separating direction other than the third direction is available as long as the separating direction may be a direction crossing a facing direction in which the electrical contact surface 611 faces the terminal portion 913.

<7. Modifications>

While the description has been made in detail with reference to specific embodiment, it would be apparent to those skilled in the art that various changes and modifications may be made thereto. In the following description, various modifications will be described while focusing on differences between the modifications and the above-described embodiment.

In the above-described embodiment, the first and second guide surfaces are inclined with respect to the third direction. However, one of the first and second guide surfaces may extend parallel to the third direction, and remaining one of the first and second guide surfaces may be inclined with respect to the third direction. Further, in the above-described embodiment, the first and second guide surfaces are flat surfaces. However, at least one of the first and second guide surfaces may be a curved surface.

According to the above-described embodiment, the bosses provided at the holder is inserted into the through-holes provided in the first cover 45. However, the bosses may be provided at the first cover, and the through-hole or a recessed portion into which the bosses are inserted may be provided at the holder. In the above-described embodiment, the boss provided at the holder is inserted into the recessed portion provided the casing. However, the boss may be provided at the casing, and through-holes or recessed portions into which the boss is inserted may be provided at the holder.

Further, in the above-described embodiment, the coil spring 73 is used as the elastic member. However, other kinds of springs such as a leaf spring and a torsion spring are available instead of the coil spring 73. Further, the elastic member may be omitted in the IC chip assembly. That is, expansion and contraction of the IC chip assembly in the second direction is not necessarily required. In the this case, the image forming apparatus may include a mechanism for applying external force to the IC chip assembly so as to press the electrical contact surface against the terminal portion.

Further, in the above-described embodiment, the developing cartridge 1 is attached to the drawer unit. However, the developing cartridge may be attached to a drum cartridge including the photosensitive drum instead of the drawer unit. In this case, the drum cartridge to which the developing cartridge is attached may be attached to the main body of the image forming apparatus. In other words, the frame may be a drum cartridge which is attached to and detached from the main body of the image forming apparatus. Further, the developing cartridge may be directly attached to the main body of the image forming apparatus without employing the drawer unit or the drum cartridge. Further, the photosensitive drum may be provided in the main body of the image forming apparatus.

Further, in the above-described embodiment, the IC chip including the electrical contact surface is fixed to the outer surface of the holder. However, only an electrical contact surface configured to contact an electric connector may be fixed to the outer surface of the holder. In this case, a portion of the IC chip other than the electrical contact surface may be positioned at a portion of the developing cartridge different from the above-described embodiment.

Further, in the above-described embodiment, the plurality of gears in the first gear portion and the second gear portion are in meshing engagement with each other. However, engagement with frictional force is available instead of the meshing engagement. For example, friction member such as rubber may be provided at each of outer circumferential surfaces of the two gear portions, instead of the plurality of gear teeth.

Further, in the above-described embodiment, the developing cartridge 1 including the developing roller 30 is used as the cartridge. However, a cartridge omitting the developing cartridge is available as long as the cartridge can be attached to the frame.

Further, each component used in the image forming apparatus may have shape or profile different from that in the above-described embodiment. Further, various features appearing in the above described embodiment and the modifications may be suitably combined together avoiding conflicting combination.

What is claimed is:

1. An image forming apparatus comprising:

a cartridge comprising:

a casing extending in a first direction and configured to accommodate developing agent;

a storage medium including an electrical contact surface; and a holder positioned at one side of the casing in the first direction, the holder including a first outer surface, the electrical contact surface being held at the first outer surface, the holder having one end portion in a second direction crossing the electrical contact surface, the first outer surface being positioned at the one end portion of the holder, the first outer surface being movable with respect to the casing in the second direction; and a frame to which the cartridge is attachable, the first outer surface moving with respect to the casing in the second direction in a case where the cartridge is attached to the frame, the frame having an insertion opening, the frame including:

a first guide surface;

a second guide surface spaced away from the first guide surface in the second direction, wherein the holder is inserted between the first guide surface and the second guide surface in an inserting direction in the case where the cartridge is attached to the frame, and wherein a gap distance between the first guide surface and the second guide surface in the second direction is gradually reduced from a first distance to a second distance in the inserting direction;

an electrical contact configured to contact the electrical contact surface, the electrical contact being positioned farther from the insertion opening than the first guide surface is from the insertion opening; and a support surface facing the electrical contact in the second direction, a gap distance between the electrical contact and the support surface being greater than the second distance.

2. The image forming apparatus according to claim 1, wherein, in a case where the cartridge is attached to the frame, the electrical contact surface and the electrical contact contacting each other after the first outer surface and the first guide surface contact each other.

3. The image forming apparatus according to claim 1, wherein the holder further includes a second outer surface positioned at another end portion of the holder in the second direction, the second outer surface being movable with respect to the first outer surface in the second direction, a distance between the first outer surface and the second outer surface in the second direction being changed during insertion of the holder between the first guide surface and the second guide surface.

4. The image forming apparatus according to claim 3, wherein the holder further includes an elastic member positioned between the first outer surface and the second outer surface, the elastic member being expandable and contractible in the second direction, the elastic member having a length in the second direction, the length being changed during the insertion of the holder between the first guide member and the second guide member, the electrical contact surface being brought into contact with the electrical contact by an elastic force of the elastic member.

5. The image forming apparatus according to claim 1, wherein the first guide surface and the second guide surface are flat surfaces inclined with respect to the inserting direction.

6. The image forming apparatus according to claim 1, wherein the first outer surface has a recessed portion recessed in the second direction, the electrical contact surface being positioned at the recessed portion.

7. The image forming apparatus according to claim 6, wherein the first outer surface of the holder includes a surface positioned adjacent to the electrical contact surface in the first direction, the electrical contact surface being recessed relative to the surface, the surface contacting the first guide surface during insertion of the holder between the first guide surface and the second guide surface.

8. The image forming apparatus according to claim 1, wherein the frame further includes a third guide surface and a fourth guide surface positioned spaced away from the third guide surface in the first direction, wherein the holder is inserted between the third guide surface and the fourth guide surface in a case where the cartridge is attached to the frame in the inserting direction, and wherein a gap distance between the third guide surface and the fourth guide surface in the first direction is gradually reduced in the inserting direction.

9. The image forming apparatus according to claim 8, wherein the third guide surface and the fourth guide surface are positioned closer to the insertion opening than the electrical contact is to the insertion opening.

10. The image forming apparatus according to claim 9, wherein the third guide surface and the fourth guide surface are positioned closer to the insertion opening than the first guide surface and the second guide surface are to the insertion opening.

11. The image forming apparatus according to claim 1, wherein the frame further includes a stop surface facing the holder in the inserting direction, the stop surface being positioned farther from the insertion opening than the electrical contact is from the insertion opening.

12. The image forming apparatus according to claim 1, wherein the frame further includes a fifth guide surface facing the holder in the inserting direction, the fifth guide surface being positioned closer to the insertion opening than the electrical contact is to the insertion opening.

13. The image forming apparatus according to claim 1, wherein the frame includes at least one photosensitive drum rotatable about a first axis extending in the first direction.

14. The image forming apparatus according to claim 1, wherein the frame further includes a plurality of photosensitive drums and a plurality of slots, wherein the cartridge is attachable to each of the plurality of slots, and wherein each of the plurality of photosensitive drums is provided at corresponding one of the plurality of slots.

15. The image forming apparatus according to claim 1, wherein the frame is a drum cartridge configured to be attached to and detached from a main body of the image forming apparatus.

16. The image forming apparatus according to claim 1, wherein the cartridge further includes a developing roller rotatable about a second axis extending in the first direction.

* * * * *